United States Patent [19]

Taylor

[11] 4,161,254

[45] * Jul. 17, 1979

[54] ANCHOR MEMBER FOR UNITIZING A PLURALITY OF CONTAINERS

[76] Inventor: Charles F. Taylor, 150 E. Industry, La Habra, Calif. 90631

[ * ] Notice: The portion of the term of this patent subsequent to Jan. 24, 1995, has been disclaimed.

[21] Appl. No.: 839,892

[22] Filed: Oct. 6, 1977

Related U.S. Application Data

[63] Continuation-in-part of Ser. No. 808,297, Jun. 20, 1977, abandoned, and a continuation-in-part of Ser. No. 679,090, Apr. 21, 1976, Pat. No. 4,069,927.

[51] Int. Cl.[2] ..... B65G 1/14

[52] U.S. Cl. ..... 206/504; 105/366 E; 105/463; 206/821

[58] Field of Search ..... 214/10.5 S, 10.5 R; 206/821; 105/366 R, 366 E, 373, 463, 486, 489

[56] References Cited

U.S. PATENT DOCUMENTS

| | | | |
|---|---|---|---|
| 1,514,512 | 11/1924 | Fisher | 206/821 |
| 1,953,303 | 4/1934 | Kohlmann | 214/10.5 R X |
| 3,369,676 | 2/1968 | Swetnam | 214/10.5 R |
| 4,069,927 | 1/1978 | Taylor | 214/10.5 R |

*Primary Examiner*—Francis S. Husar
*Assistant Examiner*—George F. Abraham
*Attorney, Agent, or Firm*—Shlesinger, Arkwright, Garvey & Dinsmore

[57] ABSTRACT

An anchor member for unitizing a plurality of containers arranged in laterally adjacent and superimposed relationship, the anchor member including a flat body having a single wall portion extending therefrom transversely of one face of the flat body and adapted to be positioned in the space between laterally adjacent containers, and pins or teeth extending from both faces of the body for grippingly engaging the walls of adjacent and superimposed containers.

1 Claim, 5 Drawing Figures

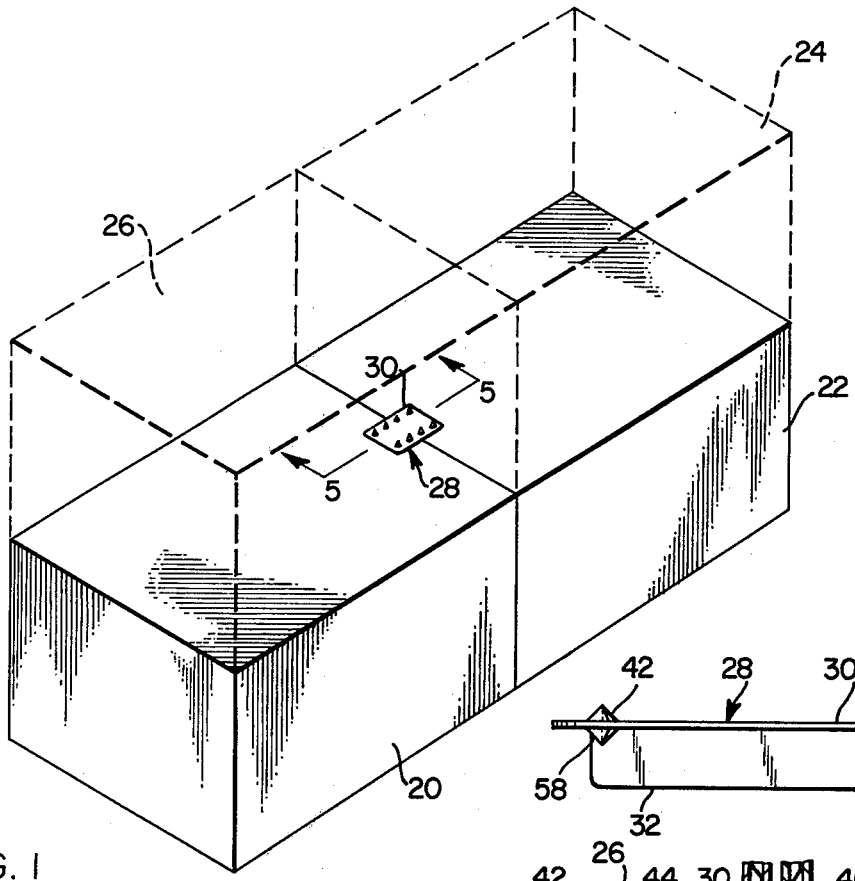
FIG. 1
FIG. 4
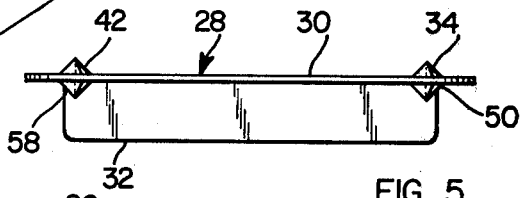
FIG. 5
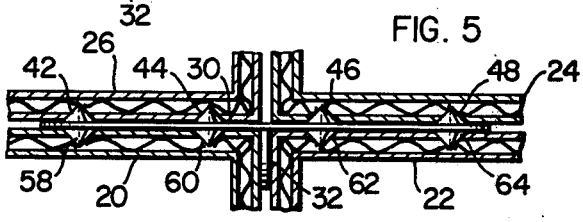
FIG. 2
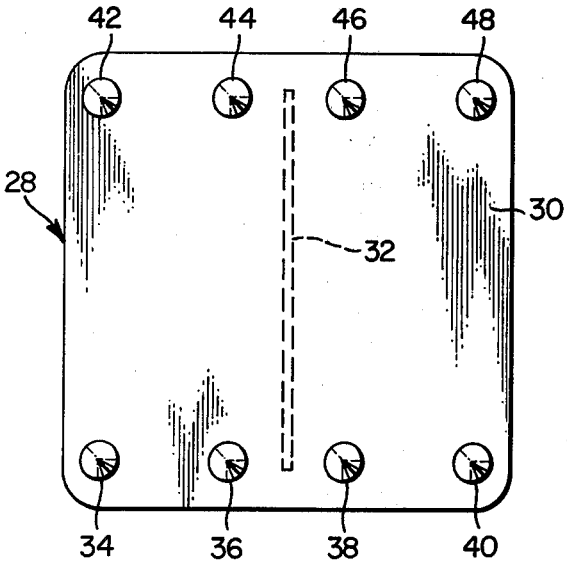
FIG. 3
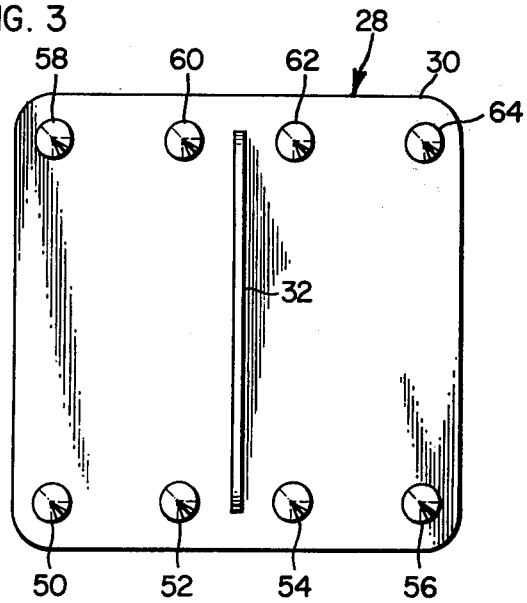

ANCHOR MEMBER FOR UNITIZING A PLURALITY OF CONTAINERS

This application is a continuation-in-part of application Ser. No. 679,090 now U.S. Pat. No. 4,069,927 granted Jan. 24, 1978 filed Apr. 21, 1976 and 808,297, now abandoned, filed June 20, 1977.

BACKGROUND OF INVENTION

It is often desirable to join a plurality of containers together as a unit for the purpose of transporting them from place to place by means of fork lift trucks or like equipment. Various means have been devised for unitizing containers for this purpose.

In application Ser. No. 679,090, there is disclosed an anchor member for unitizing containers by placing the same at the corner juncture between a plurality of laterally adjacent containers. Application Ser. No. 808,297, now abandoned discloses an anchor member which unitizes two containers which are in stacked relationship.

Neither of the above anchor members are particularly adapted for unitizing a pair of laterally adjacent containers on which are stacked a pair of superimposed containers.

SUMMARY OF THE INVENTION

The present invention comprises an anchor member of simple, economic construction which may be interposed between a pair of laterally adjacent containers having a second pair of containers stacked on top of the laterally adjacent containers.

The anchor member includes a flat body having a wall extending outwardly from one face intermediate the length thereof and insertable into the space between the laterally adjacent containers, the body further including pins or teeth on both sides of the flat body for impinging engagement with the pair of laterally adjacent containers and the pair of containers superimposed thereon.

The present anchor member is operatively engaged with the containers by placing the same between two laterally adjacent containers with the transverse wall extending into the space between the adjacent containers, the anchor member being urged into impinging engagement with said adjacent containers and the superimposed containers under the weight of the upper containers placed on top of the anchor member.

DESCRIPTION OF FIGURES OF THE DRAWING

FIG. 1 is a perspective view of laterally adjacent and stacked containers, illustrating the use of the present invention;

FIG. 2 is a top plan view of the anchor member of the present invention;

FIG. 3 is a bottom plan view of the same;

FIG. 4 is an end elevational view of the same, and

FIG. 5 is an enlarged sectional view taken along the lines 5—5 of FIG. 1, looking in the direction of the arrows.

DETAILED DESCRIPTION OF THE INVENTION

In FIG. 1 there is illustrated the application of the present invention in unitizing a plurality of containers including laterally adjacent containers 20 and 22 on which are superimposed containers 24 and 26, all of which may be of corrugated cardboard or other suitable material. The present anchor member is generally designated 28 and is positioned to span laterally adjacent containers.

Anchor member 28 includes a flat body 30 of any suitable geometric configuration but preferably of rectangular shape and made of a rigid plastic material such as polypropylene.

As shown to advantage in FIGS. 2 to 4, a short flangelike rectilinear wall 32 extends transversely of the bottom face of flat body 30 at substantially the midpoint thereof for the majority of one dimension of the flat body. The upper face of flat body 30 is provided with a plurality of spaced pins or teeth 34, 36, 38, 40, adjacent one edge thereof and a plurality of like pins or teeth 42, 44, 46, 48 along the opposite edge thereof. The bottom face of flat body 30 is likewise provided with a series of pins or teeth 50, 52, 54, 56 which are along the same edge as, and in opposed relation to, pins 34, 36, 38, 40, and pins or teeth 58, 60, 62, 64 which are along the same body edge as, and in opposed relation to, pins 42, 44, 46, 48.

All of the pins or teeth are of substantially the same height and, as shown in FIG. 5, pierce the outer layer of the corrugated cardboard from which the containers are made, but do not pierce the inner layer thereof, thereby preserving the contents of the container from air or contaminants.

Optimum results have been obtained with an anchor member comprising a flat body which is approximately three inches square having a transverse wall of substantially four-tenths of an inch in height and pins or teeth of approximately one-tenth of an inch in length.

Anchor member 28 is preferably positioned as shown in FIG. 1 spanning two laterally adjacent containers 20 and 22 with wall 32 extending into the space between the containers, pins 34, 36, 46, 48 engaging container 20 and pins 38, 40, 42, 44 engaging container 22. Wall 32 serves to properly position the anchor member and to prevent movement thereof when containers 24 and 26 are placed on top of containers 20 and 22.

When containers 24 and 26 are positioned on containers 20 and 22, the weight thereof causes the teeth of the anchor member to penetrate the walls of the containers and thereby automatically effect gripping engagement of the anchor member with the containers.

The anchor member of the present invention is of simple, economic construction, and requires no further extraneous act by the user to position the same for use to unitize a plurality of containers.

While there has been herein shown and described the presently preferred forms of this invention, it is to be understood that such has been done for purposes of illustration only, and that various changes may be made therein within the scope of the appended claims.

What is claimed is:

1. An anchor member for unitizing a plurality of corrugated containers having inner and outer layers, said anchor member including:

(a) a flat, rigid body of substantially rectangular shape for placement at the junction between laterally adjacent corrugated cardboard containers having flat surfaces disposed in substantially the same plane, one face of said flat body being engaged with a portion of the flat surface of adjacent containers (b) a single rectilinear wall extending outwardly from said one face of said flat body for engagement with portions of adjacent containers proximate the flat surfaces engaged by said flat body, said wall being proximate the midpoint of one dimension of the flat body and extending transversely for the majority of another dimension, and (c) a plurality of spaced pins projecting outwardly from said one face of said flat body on both sides of said single wall, and from said other face of said flat body, for engaging portions of the flat surfaces of the adjacent containers to prevent relative movement thereof (d) said spaced pins being of predetermined uniform height to pierce the outer layer of the corrugated cardboard containers but not the inner layer thereof, thereby preserving the contents of the containers from contamination.

* * * * *